US006867168B2

(12) United States Patent
Laney et al.

(10) Patent No.: US 6,867,168 B2
(45) Date of Patent: Mar. 15, 2005

(54) MICROBEAD AND IMMISCIBLE POLYMER VOIDED POLYESTER FOR THERMAL IMAGING MEDIAS

(75) Inventors: Thomas M. Laney, Spencerport, NY (US); Teh-Ming Kung, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 78 days.

(21) Appl. No.: 10/324,490

(22) Filed: Dec. 20, 2002

(65) Prior Publication Data

US 2004/0121910 A1 Jun. 24, 2004

(51) Int. Cl.[7] ..... B41M 5/035; B41M 5/38

(52) U.S. Cl. ..... 503/227; 428/32.39; 428/304.4; 428/318.4; 428/327; 428/480

(58) Field of Search ..... 428/32.39, 304.4, 428/318.4, 327, 480; 503/227, 200, 226

(56) References Cited

U.S. PATENT DOCUMENTS

| | | | | |
|---|---|---|---|---|
| 4,187,113 A | | 2/1980 | Mathews et al. | |
| 4,994,312 A | | 2/1991 | Maier et al. | 428/36.5 |
| 5,100,862 A | | 3/1992 | Harrison et al. | |
| 5,538,935 A | * | 7/1996 | Hastreiter et al. | 503/227 |
| 6,096,684 A | | 8/2000 | Sasaki et al. | |

FOREIGN PATENT DOCUMENTS

| | | |
|---|---|---|
| EP | 0 582 750 A1 | 2/1994 |
| JP | 63-198645 | 8/1988 |

OTHER PUBLICATIONS

Co–pending U.S. Appl. No. 10/033,481, Laney et al., *Thermal Dye Transfer Receiver Element With Microvoided Support*, (D–82665/CPK).

* cited by examiner

*Primary Examiner*—Bruce H. Hess
(74) *Attorney, Agent, or Firm*—Lynne M. Blank

(57) ABSTRACT

The present invention relates to a thermal image recording element comprising a microvoided layer comprising a continuous phase polyester matrix having dispersed therein crosslinked organic microbeads and non-crosslinked polymer particles that are immiscible with the polyester matrix of the microvoided layer.

32 Claims, No Drawings

MICROBEAD AND IMMISCIBLE POLYMER VOIDED POLYESTER FOR THERMAL IMAGING MEDIAS

CROSS REFERENCE TO RELATED APPLICATIONS

Reference is made to commonly assigned, co-pending U.S. Patent Applications: Ser. No. 10/326,448 by Thomas M. Laney and Teh-Ming Kung filed of even date herewith entitled "MICROBEAD AND IMMICIBLE POLYMER VOIDED POLYESTER FOR INKJET IMAGING MEDIAS"; and Ser. No. 10/326,451 by Thomas M. Laney and Teh-Ming Kung filed of even date herewith entitled "MICROBEAD AND IMMICIBLE POLYMER VOIDED POLYESTER FOR IMAGING MEDIAS", the disclosures of which are incorporated herein.

FIELD OF THE INVENTION

The present invention relates to voided films containing microbead and non-crosslinked polymer particles, immiscible with the polyester matrix for use in thermal imaging media.

BACKGROUND OF THE INVENTION

Recording elements or media typically comprise a substrate or a support material optionally having on at least one surface thereof an image-forming layer. The elements include those intended for reflection viewing, which usually have an opaque support, and those intended for viewing by transmitted light, which usually have a transparent support.

While a wide variety of different types of image-recording elements have been proposed, there are many unsolved problems in the art and many deficiencies in the known products which have severely limited their commercial usefulness. These deficiencies vary with the type of image recording element.

Various arrangements have been proposed to improve the imaging quality of dye image receiving layers in thermal dye-transfer elements. JP 88-198,645 suggests the use of a support comprising a polyester matrix with polypropylene particles as a dye donor element. EP 582,750 suggests the use of a non-voided polyester layer on a support.

U.S. Pat. No. 5,100,862 relates to microvoided supports for dye-receiving elements used in thermal dye transfer systems. Polymeric microbeads are used as void initiators in a polymeric matrix to enable higher dye transfer efficiency. A problem exists with such support, however, in that, in order to attain the high level of voiding desirable for desired dye transfer efficiency, the volumetric loading of the microbeads needs to be above 25% by volume of the polymeric matrix. The degree of voiding is preferably from about 30 to 60 volume percent. At these levels of loading the tear strength of the film during manufacture is very low and also results in very poor manufacturing efficiency due to tearing of the support.

U.S. Pat. No. 6,096,684 relates to porous polyester films suitable as supports for receiving elements used in thermal dye transfer systems. Polymers immiscible with a polyester are used in a base layer while an adjacent layer, upon which a dye receiving layer is formed, contains a polyester containing dispersed inorganic particles as void initiators. These inorganic particles are less than 1.0 $\mu$m in size. The porosity of layer (B) is specified to be not less than 20% by volume. This support solves the problem of poor adhesion of imaging layers to a support consisting only of layer (A). This support has also been shown to be manufacturable at high efficiency. A problem exists with this support, however, in that the hardness of the inorganic void initiators results in poor contact with the dye donor element. This results in low dye transfer efficiency for elements using such supports. This problem was addressed by U.S. application Ser. No. 10/033,481 whereby the inorganic particles of layer (B) in U.S. Pat. No. 6,096,684 are replaced with polymeric microbeads. This significantly improved the dye transfer efficiency. A problem still exists with U.S. application Ser. No. 10/033,481, however, in that the support must be multi-layered, as the top porous layer tears apart when attempting to manufacture it as a single layered substrate. As stated previously, this requires that the manufacturing of such a support include co-extrusion. Again, it is desirable to extrude only a single layer when producing a substrate for thermal dye-transfer elements as this enables most manufacturing machines capable of manufacturing polyester films to produce such a substrate without the need of co-extrusion capability.

The use of immiscible polymer particles, such as olefins, in the polyester as a void initiator has been described in U.S. Pat. No. 4,187,113. This means of voiding is very robust and results in a low cost means to void polyester. The immiscible polymer may be added simultaneously with manufacturing the substrate. Such voided layers have been shown to be manufacturable as a single layered media. The use of such voided polyester layers in a thermal dye transfer imaging media has been shown to be deficient in terms of image quality. Thus the use of immiscible polymer particles does not by itself offer a solution to the problems observed with microbeads as described above.

The problem to be solved by the present invention is to formulate an opaque thermal dye transfer imaging media with a single layer substrate suitable for use in a thermal dye transfer printer, which is capable of recording images (including color images) having high optical densities, high image quality, capable of being manufactured at a relatively low cost, and capable of being produced on existing polyester film manufacturing machines without the need of co-extrusion capability.

SUMMARY OF THE INVENTION

The present invention relates to a thermal image recording element comprising a microvoided layer comprising a continuous phase polyester matrix having dispersed therein crosslinked organic microbeads and non-crosslinked polymer particles that are immiscible with the polyester matrix of said microvoided layer.

ADVANTAGEOUS EFFECT OF THE INVENTION

The present invention includes several advantages, not all of which may be incorporated in any one embodiment. In one advantage, the invention provides improved imaging medias. In another advantage, the invention provides imaging medias which comprise substrates that may be manufactured as a single layer. In another advantage, the invention provides improved image quality with respect to image density and low graininess and lower manufacturing cost for prior art voided polyester substrate imaging medias.

DETAILED DESCRIPTION OF THE INVENTION

The invention relates to image recording elements comprising a voided polyester matrix layer. The recording element may additionally comprise an image recording layer.

The voided polyester matrix layer of the element comprises a continuous phase polyester matrix having dispersed therein crosslinked organic microbeads and non-crosslinked polymer particles. The non-crosslinked polymer particles are immiscible with the polyester matrix to form a microvoided layer with enhanced strength and quality.

In the prior art, microvoided polyester matrix layers have been formed by using either microbeads or non-crosslinked polymer particles that are immiscible with the polyester matrix. However, when only microbeads are used, a coextruded support layer is needed to enable manufacturability without tears.

When used as a thermal dye transfer imaging media, the image quality is very poor if only non-crosslinked polymer particles that are immiscible with the polyester matrix are used in the microvoided layer.

It has been unexpectedly discovered that by mixing both the crosslinked organic microbeads and the non-crosslinked polymer particles that are immiscible with the polyester matrix into the polyester matrix of the microvoided layer the deficiencies of the void initiators when used singularly are overcome. The combination of the present invention enables the production of a single layer thermal imaging element which resist tearing and has improved grainy appearance while maintaining important properties, for example, high image density.

The terms as used herein, "top", "upper", and "face" mean the side or toward the side of the element receiving an image. The terms "bottom", "lower side", and "back" mean the side opposite that which receives an image.

The term voids or microvoids means pores formed in an oriented polymeric film during stretching as the result of a void-initiating particle. In the present invention, these pores are initiated by either crosslinked organic microbeads or non-crosslinked polymer particles. The term microbead means synthesized polymeric spheres which, in the present invention, are cross-linked.

The continuous phase polyester matrix of the microvoided layer comprises any polyester and preferably comprises polyethylene(terephthalate) or a copolymer thereof. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, for example, those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

The polyester utilized in the invention should have a glass transition temperature from 50 degrees C. to 150 degrees C., preferably from 60 to 100 degrees C., should be orientable, and have an intrinsic viscosity of at least 0.50 centipoise (cps), preferably from 0.55 to 0.9 cps. Examples include a blend comprising polyethylene(terephthalate) and poly(1,4-cyclohexylene dimethyhlene terephthalate.

The image recording element of the present invention comprises crosslinked organic microbeads. These crosslinked organic microbead spheres may range in size from 0.2 to 30 micrometers. They are preferably in the range of from 0.5 to 5.0 $\mu$m. Crosslinked organic microbeads comprising a polystyrene, polyacrylate, polyallylic, or poly (methacrylate) polymer are preferred.

Preferred polymers for use in the crosslinked organic microbeads may be cross-linked and may be selected from the group consisting of alkenyl aromatic compounds having the general formula:

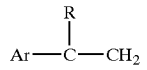

wherein Ar represents an aromatic hydrocarbon moiety, or an aromatic halohydrocarbon moiety of the benzene series and R may be hydrogen or methyl moiety, acrylate-type monomers including monomers of the formula:

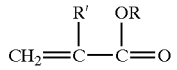

wherein R may be selected from the group consisting of hydrogen and an alkyl moiety containing from 1 to 12 carbon atoms and R' may be selected from the group consisting of hydrogen and methyl; copolymers of vinyl chloride and vinylidene chloride, acrylonitrile and vinyl chloride, vinyl bromide, vinyl esters having the formula:

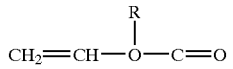

wherein R may bean alkyl group containing from 2 to 18 carbon atoms; acrylic acid, methacrylic acid, itaconic acid, citraconic acid, maleic acid, fumaric acid, oleic acid, vinylbenzoic acid; the synthetic polyester resins which may be prepared by reacting terephthalic acid and dialkyl terephthalics or ester-forming derivatives thereof, with a glycol of the series $HO(CH_2)_nOH$, wherein n may be a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinyl-benzene, diethylene glycol dimethacrylate, oiallyl fumarate, diallyl phthalate, and mixtures thereof.

Examples of typical monomers for making the crosslinked organic microbeads include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethyl-propane sulfonic acid, vinyl toluene, trimethylol propane triacrylate. Preferably, the cross-linked polymer may be poly(butyl acrylate) or poly(methyl methacrylate). Most preferably, it is a mixture of the two, and the cross-linking agent is trimethylol propane triacrylate.

In the present invention, for the polymer used to form the crosslinked organic microbead to have suitable physical properties such as resiliency, the polymer may be cross-linked. In the case of styrene cross-linked with divinylbenzene, the polymer may be from 2.5 to 50% cross-linked, and preferably from 20 to 40% cross-linked. Percent cross-linked means the mol % of cross-linking agent based on the amount of primary monomer. Such limited cross-linking produces crosslinked organic microbeads which are sufficiently coherent to remain intact during orientation of the continuous polymer. Crosslinked organic microbeads of such cross-linking may also be resilient, so that when they are deformed or flattened during orientation by pressure from the matrix polymer on opposite sides of the crosslinked organic microbeads, they subsequently resume their normal spherical shape to produce the largest possible voids around the crosslinked organic microbeads, thereby producing articles with less density.

The crosslinked organic microbeads may have a coating of a "slip agent". "Slip" means the friction at the surface of the crosslinked organic microbeads is greatly reduced. Actually, it is believed this may be caused by the silica acting as miniature ball bearings at the surface. Slip agent may be formed on the surface of the crosslinked organic microbeads during their formation by including it in the suspension polymerization mix. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. Conventional suspension polymerization processes, wherein the slip agent is added to the suspension, are preferred.

The crosslinked organic microbeads coated with slip agent may be prepared by various methods. The crosslinked organic microbeads may be prepared, for example, by a procedure in which monomer droplets containing an initiator may be sized and heated to give solid polymer spheres of the same size as the monomer droplets. In a preferred method, the polymer may be polystyrene cross-linked with divinylbenzene. The crosslinked organic microbeads may have a coating of silica. The concentration of divinylbenzene may be adjusted up or down to result in from 2.5 to 50% cross-linking by the active cross-linker, and preferably from 10 to 40% cross-linking by the active cross-linker. Of course, monomers other than styrene and divinylbenzene may be used in similar suspension polymerization processes known in the art. Also, other initiators and promoters may be used as known in the art. Slip agents other than silica may also be used. For example, a number of LUDOX® colloidal silicas are available from DuPont. LEPANDIN® colloidal alumina is available from Degussa. NALCOAG® colloidal silicas are available from Nalco, and tin oxide and titanium oxide are also available from Nalco.

Crosslinked organic microbead size may be regulated by the ratio of silica to monomer. For example, the following ratios produce the indicated size crosslinked organic microbead:

| Crosslinked Organic Microbead Size, $\mu$m | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The crosslinked organic microbeads should be dispersed into the polyester matrix prior to extruding a pre-stretched film. This may be typically accomplished using a melt compounding process utilizing a twin screw extruder.

Processes well known in the art yield crosslinked organic microbeads suitable for use in the present invention. The processes known for making non-uniformly sized crosslinked organic microbeads may be characterized by broad particle size distributions and the resulting crosslinked organic beads may be classified by screening to produce beads spanning the range of the original distribution of sizes. Other processes such as suspension-polymerization and limited coalescence directly yield very uniformly sized microbeads. Preferably, the crosslinked organic microbeads are synthesized using the limited coalescence process. This process is described in detail in U.S. Pat. No. 3,615,972. Preparation of the coated crosslinked organic microbeads for use in the present invention does not utilize a blowing agent as described in U.S. Pat. No. 3,615,972.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which may be as large as 0.3 and sometimes 0.5 centimeter in diameter, are quite stable, as regards further coalescence, and are remarkably uniform in size. If such a large droplet dispersion is vigorously agitated, the droplets may be fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying the limited coalescence phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, that is, on the surface of the oil droplets. It is thought that droplets which are substantially covered by such solid colloid may be stable to coalescence while droplets which are not so covered may not be stable. In a given dispersion of a polymerizable liquid, the total surface area of the droplets is a function of the total volume of the liquid and the diameter of the droplets. Similarly, the total surface area barely coverable by the solid colloid, for example, in a layer one particle thick, is a function of the amount of the colloid and the dimensions of the particles thereof. In the dispersion as initially prepared, for example, by agitation, the total surface area of the polymerizable liquid droplets may be greater than may be covered by the solid colloid. Under quiescent conditions, the unstable droplets begin to coalesce. The coalescence results in a decrease in the number of oil droplets and a decrease in the total surface area thereof up to a point at which the amount of colloidal solid may be barely sufficient to cover the total surface of the oil droplets, whereupon coalescence substantially ceases.

If the solid colloidal particles do not have nearly identical dimensions, the average effective dimension may be estimated by statistical methods. For example, the average effective diameter of spherical particles may be computed as the square root of the average of the squares of the actual diameters of the particles in a representative sample.

It may be beneficial to treat the uniform droplet suspension prepared as described above to render the suspension stable against congregation of the oil droplets. This further stabilization may be accomplished by gently admixing an agent capable of greatly increasing the viscosity of the aqueous liquid with the uniform droplet dispersion. For this purpose, any water-soluble or water-dispersible thickening agent may be used that is insoluble in the oil droplets and that does not remove the layer of solid colloidal particles covering the surface of the oil droplets at the oil-water interface. Examples of suitable thickening agents may be sulfonated polystyrene, for example, water-dispersible, thickening grade, hydrophilic clays such as Bentonite, digested starch, natural gums, and carboxy-substituted cellulose ethers. The thickening agent may be selected and employed in such quantities as to form a thixotropic gel in which the uniform-sized droplets of the oil may be suspended. In other words, the thickened liquid generally should be non-Newtonian in its fluid behavior, that is, of a nature to prevent rapid movement of the dispersed droplets within the aqueous liquid by the action of gravitational force due to the difference in density of the phases. The stress exerted on the surrounding medium by a suspended droplet may not be sufficient to cause rapid movement of the droplet within such non-Newtonian media. Usually, the thickener agents may be employed in such proportions relative to the aqueous liquid that the apparent viscosity of the thickened aqueous liquid is in the order of at least 500 centipoise as determined by means of a Brookfield viscometer using the No. 2 spindle at 30 rpm. The thickening agent is preferably prepared as a separate concentrated aqueous composition that is then carefully blended with the oil droplet dispersion. The resulting thickened dispersion is capable of being handled, for example, passed through pipes, and may be subjected to polymerization conditions substantially without mechanical change in the size or shape of the dispersed oil droplets.

The resulting dispersions may be particularly well suited for use in continuous polymerization procedures that may be carried out in coils, tubes, and elongated vessels adapted for continuously introducing the thickened dispersions into one end and for continuously withdrawing the mass of polymer beads from the other end. The polymerization step may also be practiced in batch manner.

The order of the addition of the constituents to the polymerization usually is not critical, but it may be more convenient to add the water, dispersing agent, and incorporated oil-soluble catalyst to the monomer mixture to a vessel and subsequently add the monomer phase to the water phase with agitation.

The following general procedure may be utilized in a limited coalescence technique:

1. The polymerizable liquid is dispersed within an aqueous nonsolvent liquid medium to form a dispersion of droplets having sizes not larger than the size desired for the polymer globules, whereupon
2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and
3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and
4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid and, hence, the diameter of the beads of polymer, may be varied predictably, by deliberate variation of the composition of the aqueous liquid dispersion, within the range of from 0.5 $\mu$m or less to 0.5 centimeter. For any specific operation, the range of diameters of the droplets of liquid and, hence, of polymer beads, has a factor in the order of three or less as contrasted to factors of 10 or more for diameters of droplets and beads prepared by usual suspension polymerization methods employing critical agitation procedures. Since the bead size, for example, diameter, in the present method is determined principally by the composition of the aqueous dispersion, the mechanical conditions, such as the degree of agitation, the size and design of the apparatus used, and the scale of operation are not highly critical. Furthermore, by employing the same composition, the operations may be repeated, or the scale of operations may be changed, and substantially the same results may be obtained.

One bead formation method may be carried out by dispersing one part by volume of a polymerizable liquid into at least 0.5, preferably from 0.5 to 10 or more parts by volume of a nonsolvent aqueous medium comprising water and at least the first of the following ingredients:

1. A water-dispersible, water-insoluble solid colloid, the particles of which, in aqueous dispersion, have dimensions in the order of from 0.008 to 50 $\mu$m, which particles tend to gather at the liquid-liquid interface or are caused to do so by the presence of
2. A water-soluble "promotor" that affects the "hydrophilic-hydrophobic balance" of the solid colloid particles; and/or
3. An electrolyte; and/or
4. Colloid-active modifiers such as peptizing agents, and surface-active agents; and usually,
5. A water-soluble, monomer-insoluble inhibitor of polymerization.

The water-dispersible, water-insoluble solid colloids may be inorganic materials, such as metal salts, hydroxides or clays, or may be organic materials, such as raw starches, sulfonated cross-linked organic high polymers, and resinous polymers.

The solid colloidal material should be insoluble but dispersible in water and both insoluble and nondispersible in, but wettable by, the polymerizable liquid. The solid colloids should be much more hydrophilic than oleophilic to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size may be approximately that of the swollen particle. The particles may be single molecules, as in the case of extremely high molecular weight cross-linked resins, or may be aggregates of many molecules. Materials that disperse in water to form true or colloidal solutions in which the particles have a size below the range stated or in which the particles may be so diffuse as to lack a discernible shape and dimension may be not suitable as stabilizers for limited coalescence. The amount of solid colloid that may be employed usually corresponds to from 0.01 to 10 or more grams per 100 cubic centimeters of the polymerizable liquid.

In order to function as a stabilizer for the limited coalescence of the polymerizable liquid droplets, it may be essential that the solid colloid should tend to collect with the aqueous liquid at the liquid-liquid interface, that is, on the surface of the oil droplets. The term "oil" may be occasionally used herein as generic to liquids that are insoluble in water. In many instances, it may be desirable to add a "promoter" material to the aqueous composition to drive the particles of the solid colloid to the liquid-liquid interface. This phenomenon is well known in the emulsion art, and is here applied to solid colloidal particles, as an expanded means of adjusting the "hydrophilic-hydrophobic balance."

Usually, the promoters are organic materials that have an affinity for the solid colloid and also for the oil droplets and that may be capable of making the solid colloid more oleophilic. The affinity for the oil surface may be due to some organic portion of the promoter molecule, while affinity for the solid colloid may be due to opposite electrical charges. For example, positively charged complex metal salts or hydroxides, such as aluminum hydroxide, may be promoted by the presence of negatively charged organic promoters such as water-soluble sulfonated polystyrenes, alignates, and carboxymethylcellulose. Negatively charged colloids, such as Bentonite, may be promoted by positively charged promoters such as tetramethyl ammonium hydroxide or chloride or water-soluble complex resinous amine condensation products, such as the water-soluble condensation products of diethanolamine and adipic acid, the water-soluble condensation products of ethylene oxide, urea and formaldehyde, and polyethylenimine. Amphoteric materials, such as proteinaceous materials like gelatin, glue, casein, albumin, or glutin, may be effective promoters for a wide variety of colloidal solids. Nonionic materials like methoxycellulose may also be effective in some instances. Usually, the promoter should be used only to the extent of a few parts per million of aqueous medium, although larger proportions may often be tolerated. In some instances, ionic materials normally classed as emulsifiers, such as soaps, long chain sulfates and sulfonates and the long chain quaternary ammonium compounds, may also be used as promoters for the solid colloids, but care should be taken to avoid causing the formation of stable colloidal emulsions of the polymerizable liquid and the aqueous liquid medium.

An effect similar to that of organic promoters may be obtained with small amounts of electrolytes, for example, water-soluble, ionizable alkalies, acids and salts, particularly those having polyvalent ions. These may be useful when the excessive hydrophilic or insufficient oleophilic characteristic of the colloid is attributable to excessive hydration of the colloid structure. For example, a suitably cross-linked sulfonated polymer of styrene may be swollen and hydrated in water. Although the molecular structure contains benzene rings which should confer on the colloid some affinity for the oil phase in the dispersion, the degree of hydration causes the colloidal particles to be enveloped in a cloud of associated water. The addition of a soluble, ionizable polyvalent cationic compound, such as an aluminum or calcium salt, to the aqueous composition may cause extensive shrinking of the swollen colloid with exudation of a part of the associated water and exposure of the organic portion of the colloid particle, thereby making the colloid more oleophilic.

The solid colloidal particles whose hydrophilic-hydrophobic balance may be such that the particles tend to gather in the aqueous phase at the oil-water interface, gather on the surface of the oil droplets, and function as protective agents during limited coalescence.

Other agents that may be employed in an already known manner to effect modification of the colloidal properties of the aqueous composition are those materials known in the art as peptizing agents, flocculating and deflocculating agents, sensitizers, and surface active agents.

It is sometimes desirable to add a few parts per million of a water-soluble, oil-insoluble inhibitor of polymerization to the aqueous liquid to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid may then be admixed with the liquid polymerizable material in such a way as to disperse the liquid polymerizable material as small droplets within the aqueous medium. This dispersion may be accomplished by any usual means, for example, by mechanical stirrers or shakers, by pumping through jets, by impingement, or by other procedures causing subdivision of the polymerizable material into droplets in a continuous aqueous medium.

The degree of dispersion, for example, by agitation, is not critical, although the size of the dispersed liquid droplets should be no larger, and may be preferably much smaller, than the stable droplet size expected and desired in the stable dispersion. When such condition has been attained, the resulting dispersion may be allowed to rest with only mild, gentle movement, if any, and preferably without agitation. Under such quiescent conditions, the dispersed liquid phase undergoes a limited degree of coalescence.

The non-cross linked polymer particles in the voided layer should be immiscible with the polyester matrix. Typical non-crosslinked polymer particles that are immiscible with the polyester matrix particles are olefins. The preferred olefin non-crosslinked polymer particles which may be blended with the polyester matrix are a homopolymers or copolymers of polypropylene or polyethylene. Polypropylene is preferred.

The preferred polyolefin non-crosslinked polymer particles used according to this invention are immiscible with the polyester matrix component of the film and exists in the form of discrete non-crosslinked polymer particles particles dispersed throughout the oriented and heat set film. Voiding occurs between the non-crosslinked polymer particles and the polyester matrix, when the film is stretched. It has been discovered that the non-crosslinked polymer particles should be blended with the linear polyester matrix prior to extrusion through the film forming die by a process which results in a loosely blended mixture and does not develop an intimate bond between the polyester matrix and the preferred polyolefin non-crosslinked polymer particles.

Such a blending operation preserves the incompatibility of the components and leads to voiding when the film is stretched. A process of dry blending the polyester matrix and preferred polyolefin non-crosslinked polymer particles has been found to be useful. For instance, blending may be accomplished by mixing finely divided, for example powdered or granular, polyester matrix and non-crosslinked polymer particles and thoroughly mixing them together, for example, by tumbling them.

In order to form the microvoided layer of this invention, crosslinked organic microbeads should first be dispersed into a polyester matrix prior to the film forming process. This may be accomplished by feeding both the polyester matrix, in either pellet or powder form, and the crosslinked organic microbeads into a twin screw extruder. The polyester matrix may be melted and the crosslinked organic microbeads may be dispersed into the polyester melt in the twin screw extruder. The resulting extrudate may be then quenched in a water bath and then pelletized into pellets to be used in the film forming process. These pellets may be then dry blended with the preferred polyolefin non-crosslinked polymer particle of choice, typically a polypropylene. The preferred polyolefin non-crosslinked polymer particle may be typically in pellet form as well. Pellets of polyester matrix may also be added to the dry blend if modifications to the volumetric loading of the crosslinked organic microbeads and the non-crosslinked polymer particles are desired. The ratio of the volume of crosslinked organic microbeads used relative to the volume of the non-crosslinked polymer particle polymer used in the final blend may range from 2:3 to 3:2. The preferred ratio is 1:1.

The resulting mixture may then be fed to the film forming extruder. The extrusion, quenching and stretching of the film may be effected by any process which is known in the art for producing oriented polyester film, for example by a flat film process or a bubble or tubular process. The flat film process is preferred for making film according to this invention and involves extruding the blend through a slit die and rapidly quenching the extruded web upon a chilled casting drum so that the polyester matrix component of the film may be quenched into the amorphous state. The quenched film may be then biaxially oriented by stretching in mutually perpendicular directions at a temperature above the glass-rubber transition temperature of the polyester matrix. Generally the film is stretched in one direction first and then in the second direction although stretching may be effected in both directions simultaneously if desired. In a typical process, the film is stretched firstly in the direction of extrusion over a set of rotating rollers or between two pairs of nip rollers and is then stretched in the direction transverse thereto by means of a tenter apparatus. The film may be stretched in each direction to 2.5 to 4.5 times its original dimension in the direction of stretching. The ratio of the stretching in each direction is preferably such as to form voids in the sheet with a width to length ratio of from 1:1 to 2:1. After the film has been stretched it may be heat set by heating to a temperature sufficient to crystallize the polyester matrix while restraining the film against retraction in both directions of stretching. When a non-crosslinked polymer particle is used in the voided layer, the voiding tends to collapse as the heat setting temperature is increased and the degree of collapse increases as the temperature increases. Hence the void volume decreases with an increase in heat setting temperatures. While heat setting temperatures up to 230° C. may be used without destroying the voids when only crosslinked organic microbeads are used in the voided layer, temperatures below 155° C. may result in a greater degree of voiding when non-crosslinked polymer particle voiding agent is used.

Blended polyester matrix, crosslinked organic microbeads, and immicible polymer which have been extruded and, for example, reduced to a granulated or flaked form, may be successfully re-extruded into a voided film. It may be thus possible to re-feed scrap film, for example as edge trimmings, through the process.

The size of the microvoids formed is determined by the size of the crosslinked organic microbead or non-crosslinked polymer particle used to initiate the void and by the stretch ratio used to stretch the oriented polymeric film. The pores may range from 0.6 to 150 μm in machine and cross machine directions of the film. They typically range from 0.2 to 30 μm in height. Preferably the height of the pores is in the range of 0.5 to 15.0 μm.

A void volume of from 25% to 55% is preferred for imaging elements not requiring absorbency as for thermal dye transfer medias and silver halide displays. The density of the microvoided layer should be less than 0.95 grams/cc. The preferred range is 0.40 to 0.90 grams/cc.

The voided layer described above may, by itself, constitute an image recording element of this invention or have adjacent image recording layers which together comprise the image recording element. The total thickness of the base may range from 20 to 400 (μm). Most applications require the base thickness to be within the range of from 30 to 300 (μm). The preferred range is from 50 to 200 (μm).

The image recording layers described above may be coated by conventional coating means commonly used in this art. Coating methods may include, but are not limited to, wound wire rod coating, knife coating, slot coating, slide hopper coating, gravure coating, spin coating, dip coating, skim-pan-air-knife coating, multilayer slide bead, doctor blade coating, gravure coating, reverse-roll coating, curtain coating, multilayer curtain coating. Some of these methods allow for simultaneous coatings of more than one layer, which is preferred from a manufacturing economic perspective if more than one layer or type of layer needs to be applied. Known coating and drying methods are described in further detail in *Research Disclosure* No. 308119, published December 1989, pages 1007–1008. After coating, the layers are generally dried by simple evaporation, which may be accelerated by known techniques such as convection heating.

The coating composition may be applied to one or both substrate surfaces through conventional pre-metered or post-metered coating methods listed above. The choice of coating process would be determined from the economics of the operation and, in turn, would determine the formulation specifications such as coating solids, coating viscosity, and coating speed.

One or more subbing layers may be present on top of the base used with the invention or between the base and the image recording layer used with the invention. These layers may add functionality such as antistatic properties, control colorimetry, and improve image recording layer adhesion to the base. This layer may be an adhesive layer such as, for example, halogenated phenols, partially hydrolyzed vinyl chloride-co-vinyl acetate polymer, vinylidene chloride-methyl acrylate-itaconic acid terpolymer, a vinylidene chloride-acrylonitrile-acrylic acid terpolymer, or a glycidyl (meth)acrylate polymer or copolymer. Other chemical adhesives, such as polymers, copolymers, reactive polymers or copolymers, that exhibit good bonding between the ink receiving layer and the support may be used. The polymeric binder in the subbing layer may be preferably a water soluble or water dispersible polymer such as poly(vinyl alcohol), poly(vinyl pyrrolidone), gelatin, a cellulose ether, a poly(oxazoline), a poly(vinylacetamide), partially hydrolyzed poly(vinyl acetate/vinyl alcohol), poly(acrylic acid), poly(acrylamide), poly(alkylene oxide), a sulfonated or phosphated polyester or polystyrene, casein, zein, albumin, chitin, chitosan, dextran, pectin, a collagen derivative, collodian, agar-agar, arrowroot, guar, carrageenan, tragacanth, xanthan, rhamsan, a latex such as poly(styrene-co-butadiene), a polyurethane latex, a polyester latex, or a poly(acrylate), poly(methacrylate), poly(acrylamide) or copolymers thereof.

These layers may be coated onto the microvoided layers after the coextrusion and orienting process or between casting and full orientation. Examples of this would be acrylic coatings for printability, coating polyvinylidene chloride for heat seal properties or barrier properties. Further examples include flame, plasma or corona discharge treatment to improve printability or adhesion. In addition it may also be possible to provide either an integral layer or a separately coated layer of either an electrical conductive or charge control layer to minimize the generation of electrostatic glow or discharge of a photosensitive imaging member. In the case of a charge control layer that is either integral to another functional layer or a functional layer by itself, the charge control agents may be substantially electrically neutral to the photosensitive emulsion or its protective overcoat.

Another preferred embodiment of this invention is an image recording element with a base comprising a voided layer as described above with a thermal dye-transfer dye-image receiving layer adjacent to the voided layer. In this embodiment, the preferred void volume of the voided layer may be from 25% to 55%. The dye-transfer dye-image receiving layer typically would comprise a polymeric binder. Typical polymeric binders may be polyester, or polycarbonate. In a preferred embodiment, the polymeric binder comprises both polyester and polycarbonate polymer. Typical weighted ratios of the polyester to the polycarbonate of the binder may be in the range of 0.8–4.0 to 1. It may be sometimes desirable for the thermal dye-transfer dye-image receiving layer to also comprise other additives. Lubricants may be added to enable improved conveyance through a printer. An example of a lubricant is a polydimethylsiloxane-containing copolymer. A preferred lubricant may be a polycarbonate random terpolymer of bisphenol A, diethylene glycol, and polydimethylsiloxane block unit and may be present in an amount of from 10% to 30% by weight of the image recording layer. Other additives that may be included in the thermal dye-transfer dye-image receiving layer may be plasticizers. Typical plasticizers that may be used comprise ester or polyester. A preferred plasticizer may be a mixture of 1,3-butylene glycol adipate and dioctyl sebacate. This plasticizer would typically be present in the dye-transfer dye-image receiving layer in a combined total amount of from 4% to 20% by weight of the dye-receiving layer.

Any of the above described embodiments of this invention could further be laminated to a substrate to further increase the utility of the imaging element. Typical substrates may be fabrics, paper, and polymer sheets. The substrate may be either transparent or opaque. Opaque substrates include plain paper, coated paper, resin-coated paper such as polyolefin-coated paper, synthetic paper, photographic paper support, melt-extrusion-coated paper, and polyolefin-laminated paper. Biaxially oriented substrates include a paper base and a biaxially oriented polyolefin sheet, typically polypropylene, laminated to one or both sides of the paper base. The substrate may also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent substrates include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. may be employed.

Used herein, the phrase "ink recording element", which may also be referred to as an "imaging element" comprises an imaging support as described above along with an image receiving or recording layer as applicable to multiple techniques governing the transfer of an image onto the imaging element. Such techniques include thermal dye transfer with thermosensitive imaging materials.

The thermal ink or dye image-receiving or recording layer of the receiving or recording elements used with the invention may comprise, for example, a polycarbonate, a polyurethane, a polyester, polyvinyl chloride, poly(styrene-co-acrylonitrile), poly(caprolactone), or mixtures thereof. The ink or dye image-receiving or recording layer may be present in any amount that may be effective for the intended purpose. An overcoat layer may be further coated over the ink or dye-receiving or recording layer, such as described in U.S. Pat. No. 4,775,657 of Harrison et al.

Ink or dye-donor elements that may be used with the ink or dye-receiving or recording element used with the invention conventionally comprise a support having thereon an ink or dye containing layer. Any ink or dye may be used in the ink or dye-donor employed in the invention, provided it is transferable to the ink or dye-receiving or recording layer by the action of heat. Ink or dye donors applicable for use in the present invention are described, for example, in U.S. Pat. Nos. 4,916,112; 4,927,803; and 5,023,228. As noted above, ink or dye-donor elements may be used to form an ink or dye transfer image. Such a process comprises image-wise-heating an ink or dye-donor element and transferring an ink or dye image to an ink or dye-receiving or recording element as described above to form the ink or dye transfer image. The thermal ink or dye transfer method of printing, an ink or dye donor element may be employed which comprises a poly(ethylene terephthalate) support coated with sequential repeating areas of cyan, magenta, and yellow ink or dye, and the ink or dye transfer steps may be sequentially performed for each color to obtain a three-color ink or dye transfer image. When the process is only performed for a single color, then a monochrome ink or dye transfer image may be obtained.

Dye-donor elements that may be used with the dye-receiving element used in the invention conventionally comprise a support having thereon a dye containing layer. Any dye may be used in the dye-donor employed in the invention provided it is transferable to the dye-receiving layer by the action of heat. Especially good results have been obtained with sublimable dyes. Dye donors applicable for use in the present invention are described, for example, in U.S. Pat. Nos. 4,916,112; 4,927,803 and 5,023,228, the disclosures of which are incorporated by reference. Specific examples of such dyes include the following:

Magenta Dye M-1

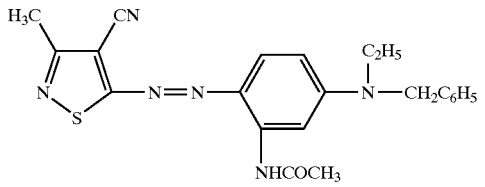

-continued

Magenta Dye M-2

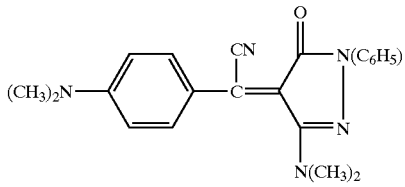

Magenta Dye M-3

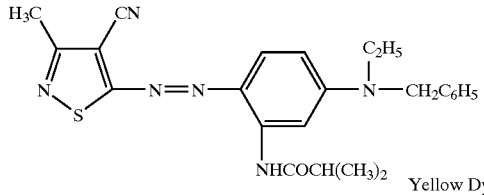

Yellow Dye Y-1

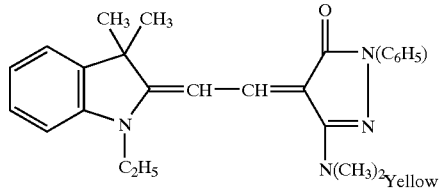

Yellow Dye Y-2

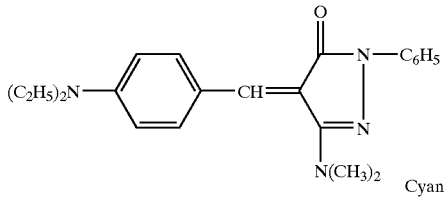

Cyan Dye C-1

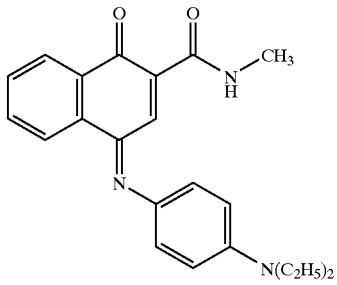

Cyan Dye C-2

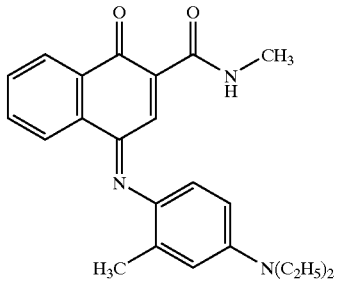

Cyan Dye C-3

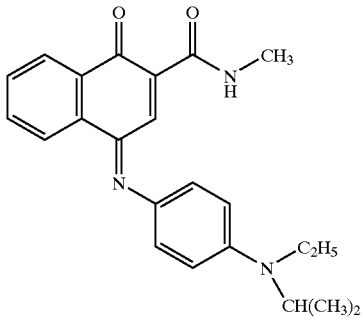

As noted above, dye-donor elements may be used to form a dye transfer image. Such a process comprises imagewise-heating a dye-donor element and transferring a dye image to a dye-receiving element as described above to form the dye transfer image.

In a preferred embodiment of the invention, a dye-donor element may be employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image may be obtained. The dye-donor element may also contain a colorless area which may be transferred to the receiving element to provide a protective overcoat. This protective overcoat may be transferred to the receiving element by heating uniformly at an energy level equivalent to 85% of that used to print maximum image dye density.

Thermal printing heads which may be used to transfer ink or dye from ink or dye-donor elements to receiving or recording elements used with the invention may be available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer may be used, such as lasers as described in, for example, GB No. 2,083,726A.

A thermal ink or dye transfer assemblage may comprise (a) an ink or dye-donor element, and (b) an ink or dye-receiving or recording element as described above, the ink or dye-receiving or recording element being in a superposed relationship with the ink or dye-donor element so that the ink or dye layer of the donor element may be in contact with the ink or dye image-receiving or recording layer of the receiving or recording element.

When a three-color image is to be obtained, the above assemblage may be formed on three occasions during the time when heat may be applied by the thermal printing head. After the first dye is transferred, the elements may be peeled apart. A second dye-donor element (or another area of the donor element with a different dye area) may be then brought in register with the dye-receiving or recording element and the process repeated. The third color may be obtained in the same manner.

The following examples are provided to illustrate the invention. They are not intended to be exhaustive of all possible variations of the invention. Parts and percentages are by weight unless otherwise indicated.

EXAMPLES

The following is an illustrative example of a possible procedure for preparing the cross-linked organic crosslinked organic microbeads coated with slip agent. In this example, the polymer is polymethyl(methacrylate) cross-linked with divinylbenzene. The crosslinked organic microbeads have a coating of silica. The crosslinked organic microbeads may be prepared by a procedure in which monomer droplets containing an initiator may be sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX® (a colloidal suspension containing 50% silica sold by DuPont). A monomer phase is prepared by combining 3317 g methyl (methacrylate), 1421 g divinylbenzene (55% active cross-linking agent; other 45% is ethyl vinyl benzene which forms part of the methyl(methacrylate) polymer chain) and 45 g VAZO® 52 (a monomer-soluble initiator sold by DuPont). The mixture is passed through a homogenizer to obtain 1.7 μm droplets. The suspension is heated overnight at 52° C. to give 4.3 kg of generally spherical crosslinked organic microbeads having an average diameter of about 5 μm with narrow size distribution (about 1–3 μm size distribution). The mol proportion of styrene and ethyl vinyl benzene to divinylbenzene is about 6.1%. The concentration of divinylbenzene may be adjusted up or down to result in about 2.5–50% (preferably 10–40%) cross-linking by the active cross-linker.

The following examples demonstrate the improvement of the invention when used as a thermal dye-transfer imaging element. Comparative examples using inorganic void initiators such as BaSO4 are omitted as previous teachings, U.S. application Ser. No. 10/033,481, have taught the disadvantage in image quality with inorganics.

Example 1

Voided Layer Made with Crosslinked Microbeads Only (Comparative)

A single layer film comprising a voided polyester layer was prepared in the following manner. The materials used in the preparation of the film are a compounded blend consisting of 35% by weight PETG 6763 resin (IV=0.73 dl/g) (an amorphous polyester resin available from Eastman Chemical Company), 35% by weight polyethylene terephthalate (PET #7352 from Eastman Chemicals), and 30% by weight cross-linked spherical poly(methyl methacrylate), (PMMA), beads 1.7 μm in diameter. The crosslinked organic beads were prepared by the limited coalescence method described heretofore. The beaded poly(methyl methacrylate) was compounded with the polyester resins through mixing in a counter-rotating twin screw extruder attached to a pelletizing die forming pellets of the resin mixture.

The resulting resin was dried at 65° C. The resin was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case, the thickness of the cast sheet was approx. 420 μm. The cast sheet was first oriented in the machine direction by stretching at a ratio of 3.3 and a temperature of 110° C.

An attempt was then made to orient the sheet in the transverse direction in a tenter frame at a ratio of 3.3 and a temperature of 100° C. However, the sheet continuously tore and a final stretched film was unattainable.

Example 2

Voided Layer Made with Non-crosslinked Polymer Particles Immiscible with the Polyester Matrix Only (Comparative)

A single layer film comprising an absorbing polyester layer was prepared in the following manner. Polyethylene terephthalate (PET #7352 from Eastman Chemicals) was dry blended with Polypropylene ("PP", Huntsman P4G2Z-073AX) at 20% weight based on the total weight of the blend and dried in a desiccant dryer at 65° C. for 12 hours.

The resin was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 420 μm. The cast sheet was first oriented in the machine direction by stretching at a ratio of 3.3 and a temperature of 110° C. This sheet was oriented in the transverse direction in a tenter frame at a ratio of 3.3 and a temperature of 100° C. without tearing. The stretched sheet was then heat set at 150° C.

Example 3

(Invention)

A single layer film comprising a voided polyester matrix layer was prepared in the following manner. Materials used in the preparation of the film were a compounded blend consisting of 35% by weight PETG 6763 resin (IV=0.73 dl/g) (an amorphous polyester resin available from Eastman Chemical Company), 35% by weight polyethylene terephthalate (PET #7352 from Eastman Chemicals), and 30% by weight cross-linked spherical poly(methyl methacrylate), (PMMA), crosslinked organic beads 1.7 μm in diameter. The crosslinked organic beads were prepared by the limited coalescence method described heretofore. The beaded poly (methyl methacrylate) was compounded with the PETG resin through mixing in a counter-rotating twin screw extruder attached to a pelletizing die forming pellets of the resin mixture. Then, polyethylene terephthalate (PET #7352 from Eastman Chemicals) was dry blended with Polypropylene ("PP", Huntsman P4G2Z-073AX) at 20% weight based on the total weight of the blend. This blend was then further blended with the aforementioned PMMA/polyester pellets at a 1:1 weight ratio. This final blend was dried in a desiccant dryer at 65° C. for 12 hours.

The dried blend was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 420 μm. The cast sheet was first oriented in the machine direction by stretching at a ratio of 3.3 and a temperature of 110° C. The sheet was then oriented in the transverse direction in a tenter frame at a ratio of 3.3 and a temperature of 100° C. The stretched sheet was then heat set at 150° C.

Preparation of Dye-Receiving Elements for Example 2 and 3

A thermal dye-receiving element was prepared from both of the above receiver supports by coating the following layers in order to the top surface of the microvoided film:

a) a subbing layer containing Prosil 221 (0.055 g/m$^2$) and Prosil 2210 (0.055 g/m$^2$) (PCR Inc.) (both are organo-oxysilanes) along with LiCl (0.0033 g/m$^2$) in an ethanol-methanol-water solvent mixture. The resultant solution (0.1133 g/m$^2$) contained approximately 1% of silane component, 1% water and 98% of 3A alcohol.

b) A dye-receiving layer containing a random terpolymer of bisphenol A polycarbonate (50 mole %), diethylene glycol (49 mole %) and polydimethylsiloxane (1 mole %) (2500 MW) block units (0.66 g/m$^2$), a random polyester terpolymer of 1,4-cyclohexylterephthalate, ethylene glycol, and 4,4'-bis(hydroxyethyl) bisphenol A (1.74 g/m$^2$), GE Lexan 141-112 (a bisphenol A polycarbonate) (General Electric Co.) (1.43 g/m$^2$), Drapex 429 polyester plasticizer (Witco Corp.) (0.20 g/m$^2$), dioctyl sebacate (Aldrich Co.) (0.20 g/m$^2$), Tinuvin 123 (a hindered aminoether)(Ciba Chem. Co.) (0.40 g/m$^2$), and FLUORAD FC-431 (a perfluorinated alkylsulfonamidoalkylester surfactant)(3M Co.) (0.011 g/m$^2$), and was coated from a solvent mixture of dichloromethane and trichloroethylene.

Preparation of Dye-Donor Elements

The dye-donor used in the example is Kodak Ektatherm ExtraLife® donor ribbon.

Dye-Donor Element

A 4-patch protective layer dye-donor element was prepared by coating on a 6 μm poly(ethylene terephthalate) support:

1) a subbing layer of titanium alkoxide (DuPont Tyzor TBT)® (0.12 g/m2) from a n-propyl acetate and n-butyl alcohol solvent mixture, and 2) a slipping layer containing an aminopropyldimethyl-terminated polydimethylsiloxane, PS513® (United Chemical Technologies, Inc.)(0.01 g/m$^2$), a poly(vinyl acetal) binder, KS-1 (Sekisui Co.) (0.38 g/m$^2$), p-toluenesulfonic acid (0.0003 g/m$^2$), polymethylsilsesquioxane beads 0.5 μm (0.06 g/m$^2$) and candellila wax (0.02 g/m$^2$) coated from a solvent mixture of diethyl ketone and methanol.

On the opposite side of the support was coated:

1) a patch-coated subbing layer of titanium alkoxide (TyzorTBT)® (0.13 g/m$^2$) from a n-propyl acetate and n-butyl alcohol solvent mixture, and 2) repeating yellow, magenta and cyan dye patches containing the compositions as noted below over the subbing layer and a protective patch on the unsubbed portion as identified below.

The yellow composition contained 0.07 g/m$^2$ of the first yellow dye illustrated above, 0.09 g/m$^2$ of the second yellow dye illustrated above, 0.25 g/m$^2$ of CAP48220 (20 s viscosity) cellulose acetate propionate, 0.05 g/m$^2$ of Paraplex G-25® plasticizer and 0.004 g/m$^2$ divinylbenzene beads (2 μm beads) in a solvent mixture of toluene, methanol and cyclopentanone (66.5/28.5/5).

The magenta composition contained 0.07 g/m$^2$ of the first magenta dye illustrated above, 0.14 g/m$^2$ of the second magenta dye illustrated above, 0.06 g/m$^2$ of the third magenta dye illustrated above, 0.28 g/m$^2$ of CAP482-20 (20 s viscosity) cellulose acetate propionate, 0.06 g/m$^2$ of Paraplex G-25® plasticizer, 0.05 g/m$^2$ of monomeric glass illustrated below, and 0.005 g/m$^2$ divinylbenzene beads (2 μm beads) in a solvent mixture of toluene, methanol and cyclopentanone (66.5/28.5/5).

The cyan composition contained 0.10 g/m$^2$ of the first cyan dye illustrated above, 0.09 g/m2 of the second cyan dye illustrated above, 0.22 g/m$^2$ of the third cyan dye illustrated above, 0.23 g/m$^2$ of CAP482-20 (20 s viscosity) cellulose acetate propionate, 0.02 g/m$^2$ of Paraplex G-25® plasticizer, 0.04 g/m$^2$ of monomeric glass illustrated below, and 0.009 g/m$^2$ divinylbenzene beads (2 μm beads) in a solvent mixture of toluene, methanol and cyclopentanone (66.5/28.5/5).

The protective patch contained a mixture of poly(vinyl acetal) (0.53 g/m$^2$) (Sekisui KS-10), colloidal silica IPA-ST (Nissan Chemical Co.) (0.39 g/m$^2$) and 0.09 g/m$^2$ of divinylbenzene beads (4 μm beads) which was coated from a solvent mixture of diethylketone and isopropyl alcohol (80:20).

Monomeric Glass

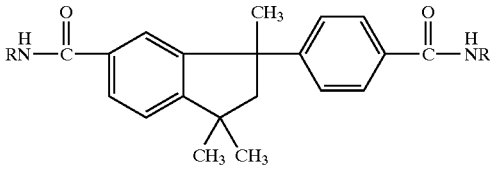

wherein R is

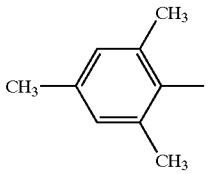

Evaluation of Dye-Transfer Printing Quality

An eleven-step sensitometric full color image was prepared from the above dye-donor and dye-receiver elements by printing the donor-receiver assemblage in a Kodak 8650 Thermal Printer. The dye-donor element was placed in contact with the polymeric receiving layer side of the receiver element. The assemblage was positioned on an 18 mm platen roller and a TDK LV5406A thermal head with a head load of 6.35 Kg was pressed against the platen roller. The TDK LV5406A thermal print head has 2560 independently addressable heaters with a resolution of 300 dots/inch and an average resistance of 3314Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density utilized 64 pulses "on" time per printed line of 5.0 msec. The voltage supplied at 13.6 volts resulted in an instantaneous peak power of approximately 58.18× 10-3 Watt/dot and the maximum total energy used to print Dmax was 0.216 mJoules/dot. This printing process heated the laminate uniformly with the thermal head to permanently adhere the laminate to the print. The donor support was peeled away as the printer advanced through its heating cycle, leaving the laminate adhered to the imaged receiver.

Visual evaluation of the images on the receivers after printing was done. The color density between examples 2 and 3 was very similar, however, ratings of the degree of grainy appearance in the low density printed areas was significantly different between the samples. Grainy appearance is a very displeasing feature in images significantly reducing their commercial value. Example 2 had a significantly more grainy appearance than Example 3.

Table 1 summarizes Examples 1 through 3 and includes a measurement of stretched thickness, density, and the void volume of the pre-coated film, where it was processable without tearing, in a final fully stretched form.

TABLE 1

| SAMPLE | DESCRIPTION | TEARABILITY | THICKNESS (um's) | DENSITY (gm/cc) | VOID VOL. (%) |
|---|---|---|---|---|---|
| Example 1 (Comparative) | 30% PMMA in Polyester | VERY POOR | NA | NA | NA |
| Example 2 (Comparative) | 20% PP in Polyester | GOOD | 71 | 0.72 | 41 |

TABLE 1-continued

| SAMPLE | DESCRIPTION | TEARABILITY | THICKNESS (um's) | DENSITY (gm/cc) | VOID VOL. (%) |
|---|---|---|---|---|---|
| Example 3 (Invention) | 1:1 blend Ex. 1 & 2 | GOOD | 73 | 0.8 | 43 |

The data in Table 1 illustrate the ability of the present invention to produce a single voided layer with reduced tearability, thus allowing the production of a single voided layer. The prior art voided layers utilizing voiding particles, such as microbeads, while able to be stretched in multi-layer format, tore apart when stretched in single layer, as illustrated by Example 1. Polymeric particles immiscible with polyester matrix were sometimes, but not always, able to survive single layer stretching, as illustrated by Example 2. Surprisingly, the present invention, Example 3, illustrates that the combination of non-crosslinked polymer particles with the cross-linked organic microbead having poor tearability characteristics produces a voided layer with good tearability, a synergistic result, not additive of the combination of Examples 1 and 2. From the examples in Table 1, it may be seen that the combination of crosslinked organic microbeads and non-crosslinked polymer particles immiscible with the polyester matrix, in this case polypropylene, enables the production of a single layer thermal imaging element that doesn't tear when performing the transverse stretch.

TABLE 2

| SAMPLE | DESCRIPTION | PRINTED DENSITY | PRINTED GRAININESS |
|---|---|---|---|
| Example 1 (Comparative) | 30% PMMA in Polyester | NA | NA |
| Example 2 (Comparative) | 20% PP in Polyester | GOOD | POOR |
| Example 3 (Invention) | 1:1 blend Ex. 1 & 2 | GOOD | GOOD |

It is evident from Table 2 that the blend of crosslinked organic microbeads and non-crosslinked polymer particles, in this case polypropylene, offers an imaging base that, together with the dye receiving layer, has improved grainy appearance over single voided layer elements made with either microbeads or non-crosslinked polymer particles, while maintaining important properties provided in some of the prior art, for example, high image density.

What is claimed is:

1. A thermal image recording element comprising a microvoided film comprising a continuous phase polyester matrix having dispersed therein crosslinked organic microbeads and non-crosslinked polymer particles that are immiscible with the polyester matrix of said microvoided film.

2. The element of claim 1 wherein the microvoided film has a void volume of at least 25% by volume.

3. The element of claim 1 wherein the microvoided film has a void volume of from 25 to 55 volume %.

4. The element of claim 1 wherein said continuous phase polyester matrix of said microvoided film comprises polyethylene(terephthalate) or a copolymer thereof.

5. The element of claim 1 wherein said continuous phase polyester matrix of said microvoided film comprises a blend comprising polyethylene(terephthalate) and poly(1,4-cyclohexylene dimethylene terephthalate).

6. The element of claim 1 wherein said crosslinked organic microbeads comprise at least one of styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethyl-propane sulfonic acid, vinyl toluene, trimethylol propane triacrylate.

7. The element of claim 1 wherein said crosslinked organic microbead comprise a poly(methyl methacrylate) or poly(butyl acrylate) polymer.

8. The element of claim 1 wherein said non-crosslinked polymer particles that are immiscible with said polyester matrix have an olefinic backbone.

9. The element of claim 8 wherein said non-crosslinked polymer particles that are immiscible with said polyester matrix comprise polymers derived from a monomer selected from propylene or ethylene.

10. The element of claim 8 wherein said polyolefin comprises polypropylene.

11. The element of claim 1 wherein said microvoided film has a density of less than 0.95 grams/cc.

12. The element of claim 1 wherein said microvoided film has a density of from 0.4 to 0.90 grams/cc.

13. The element of claim 1 wherein the total thickness of said microvoided film is from 20 to 400 micrometers.

14. The element of claim 1 wherein the total thickness of said microvoided film is from 30 to 300 micrometers.

15. The element of claim 1 wherein the total thickness of said microvoided film is from 50 to 200 micrometers.

16. The element of claim 1 further comprising an image recording layer disposed on at least 1 surface of said microvoided film wherein said image recording layer comprises a thermal dye-transfer dye-image receiving layer, wherein said microvoided film comprises a base for said element.

17. The element of claim 16 wherein said image recording layer comprises a polymeric binder containing a polyester or polycarbonate.

18. The element of claim 17 wherein said polyester and polycarbonate are present in the image recording layer in a weight ratio of 0.8–4.0 to 1.

19. The element of claim 18 wherein said polydimethylsiloxane-containing copolymer comprises a polycarbonate random terpolymer of bisphenol A, diethylene glycol, and polydimethylsiloxane block unit and is present in an amount of from 10% to 30% by weight of the said image recording layer.

20. The element of claim 9 wherein said plasticizer comprises mixture of 1,3-butylene glycol adipate and dioctyl sebacate in a combined total amount of from 4% to 20% by weight of the said dye-receiving layer.

21. The element of claim 16 wherein said image recording layer comprises a polyester and a polycarbonate polymer.

22. The element of claim 16 wherein said image recording layer further comprises a polydimethylsiloxane-containing copolymer.

23. The element of claim 16 wherein said image recording layer further comprises a plasticizer comprising an ester or polyester.

24. The element of claim 16 further comprising one or more subbing layers are present between said image recording layer and said base.

25. The element of claim 1 wherein said element is laminated to a substrate.

26. The element of claim 25 wherein said substrate comprises fabric.

27. The element of claim 25 wherein said substrate comprises paper.

28. The element of claim 25 wherein said substrate comprises a polymer sheet.

29. The element of claim 25 wherein said polymer sheet is voided.

30. The element of claim 25 wherein said polymer sheet is oriented.

31. The element of claim 1 wherein the ratio of the volume of crosslinked organic microbeads to the volume of said non-crosslinked polymer particles that are immiscible with said polyester matrix is from 3:2 to 2:3.

32. The element of claim 1 wherein the ratio of the volume of crosslinked organic microbeads to the volume of said non-crosslinked polymer particles that are immiscible with said polyester matrix is 1:1.

* * * * *